US006230511B1

(12) United States Patent
Lee et al.

(10) Patent No.: US 6,230,511 B1
(45) Date of Patent: May 15, 2001

(54) EVAPORATOR IN REFRIGERATOR

(75) Inventors: Jang Seok Lee; Jong Jin Park, both of Inchon-kwangyoksi; Tae Hee Lee, Seoul; Byung Jo Kim, Kyungki-do; Sang Wook Lee, Seoul; Jeom Yul Yun, Kyungki-do; Bong Soo Hwang; Jong Jin Kim, both of Kyungsangnam-do; Dong Won Kim, Chollabuk-do; Gyong Hwan Kweon, Pusan-si; Tae Hyun Kim, Kyungsangnam-do, all of (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/139,795

(22) Filed: Aug. 25, 1998

(30) Foreign Application Priority Data

| | | |
|---|---|---|
| Aug. 26, 1997 | (KR) | 97-41139 |
| Jan. 16, 1998 | (KR) | 98-1239 |
| Feb. 3, 1998 | (KR) | 98-2933 |
| Feb. 3, 1998 | (KR) | 98-2934 |
| Feb. 3, 1998 | (KR) | 98-2935 |
| Feb. 3, 1998 | (KR) | 98-2936 |
| Mar. 31, 1998 | (KR) | 98-11324 |
| Apr. 1, 1998 | (KR) | 98-11447 |
| Apr. 14, 1998 | (KR) | 98-13278 |

(51) Int. Cl.[7] ..... F25B 47/00
(52) U.S. Cl. ..... 62/277; 165/179
(58) Field of Search ..... 62/276, 277, 278, 62/275; 219/201; 165/64, 183, 179

(56) References Cited

U.S. PATENT DOCUMENTS

| | | | | |
|---|---|---|---|---|
| 2,541,162 | * | 2/1951 | Hermann | 165/183 |
| 2,687,626 | * | 8/1954 | Bartlowe | 62/276 |
| 3,195,627 | * | 7/1965 | Goodloe | 165/183 |
| 3,224,503 | * | 12/1965 | Konanz | 165/183 |
| 3,267,564 | * | 8/1966 | Keyes | 165/179 |
| 3,305,008 | * | 2/1967 | Jacobs | 165/179 |
| 3,343,596 | * | 9/1967 | Kritzer | 62/276 |
| 4,296,539 | * | 10/1981 | Asami | 165/179 |
| 4,369,350 | * | 1/1983 | Kobayashi et al. | 62/276 |
| 4,756,358 | * | 7/1988 | O'Neal | 62/276 |
| 5,058,266 | * | 10/1991 | Knoll | 165/179 |
| 5,186,022 | * | 2/1993 | Kim | 62/275 |
| 5,372,188 | * | 12/1994 | Dudley et al. | 165/179 |
| 5,690,167 | * | 11/1997 | Rieger | 165/179 |
| 5,765,384 | * | 6/1998 | Carlstedt et al. | 62/276 |

* cited by examiner

*Primary Examiner*—William E. Tapolcai
(74) *Attorney, Agent, or Firm*—Sheridan Ross P.C.

(57) ABSTRACT

Evaporator in a refrigerator, is disclosed, which has the refrigerant tube, cooling fins and the defrosting tube formed as one unit for simple structure and a better heat exchange efficiency, the evaporator including one pair of refrigerant tubes for flow of refrigerant therethrough, a defrosting tube disposed between the two refrigerant tubes, cooling fins formed as one unit with, and connecting the refrigerant tubes and the defrosting tube, turbulence forming means adapted to form a turbulence of air in a process of flowing around the evaporator for improving the heat exchange efficiency, internal heat conduction area enlarging means adapted to enlarge an internal area of the refrigerant tubes for improving the heat exchange efficiency, and external heat conduction area enlarging means adapted to enlarge an external area of the refrigerant tubes for improving the heat exchange efficiency.

9 Claims, 10 Drawing Sheets

EVAPORATOR IN REFRIGERATOR

BACKGROUND OF THE INVENTION

1. Field of the Invention

The present invention relates to a refrigerator, and more particularly, to an evaporator in a refrigerator which has a simple structure and an improved thermal efficiency.

2. Discussion of the Related Art

In general, the refrigerator is used for storing food at cold or freeze. As shown in FIG. 1, the refrigerator is provided with a case 10 having a storage space divided into a freeze room 10*a*and a cold room 10*b*, and parts composing a refrigerating cycle such as a compressor 20, a condenser 30, an evaporator 40, a capillary tube (not shown) for cooling down temperatures in the freeze room 10*a* and the cold room 10*b*. There is a door 12 fitted at one side of the case 10 for open/close of the freeze room 10*a* and the cold room 10*b*.

The operation of the refrigerator is as follows.

The compressor 20 compresses a gaseous refrigerant at a low pressure and a low temperature to a refrigerant at a high pressure and a high temperature. The compressed gaseous refrigerant at a high pressure and a high temperature is cooled down and condensed into high pressure liquid refrigerant as it passes through the condenser 30. The high pressure liquid refrigerant is involved in temperature and pressure drop as it passes through the capillary tube, and in altering into low temperature and low pressure gaseous refrigerant in the evaporator 40 during which the refrigerant absorbs heat from environment cooling down the environmental air. The air circulated by a fan 50 through the evaporator 40 is cooled down and flows into the freeze room 10 and the cold room 10*b*. That is, the freeze room 10 and the cold room 10*b* are cooled down by the evaporator 40 in the process of circulating the air through insides and outsides thereof by the fan 50.

Referring to FIG. 2, the evaporator 40 is provided with a refrigerant tube 42 for flow of the refrigerant therethrough, cooling fins 44 attached to the refrigerant tube 42 for obtaining a wider conduction area, and a defrosting tube 46 for removing frost on the refrigerant tube 42 and the cooling fins 44. The refrigerant tube 42 has multiple layers of a continuous 'S' bent tubes. The cooling fins 44 of thin panels are arranged across the bent refrigerant tube 42 from external view at fixed intervals parallel to each other and welded thereto. The defrosting tube 46 of bent tube along the refrigerant tube 42 is in contact with the cooling fin 44 and provided with a heater (not shown), such as electric heating coil, therein.

Therefore, according to the background art evaporator in a refrigerator explained above, the environmental temperature is lowered as the liquid refrigerant of a low temperature and a low pressure passed through the capillary tube absorbs heat as the refrigerant evaporates during the refrigerant passes through the refrigerant tube 42. The wider conduction area of the refrigerant tube 42 provided by the cooling fin 44 improves a heat exchange efficiency. Frost on the refrigerant tube 42 and the cooling fin 44 formed by a temperature difference between the refrigerant and the ambient temperature is removed as the refrigerant tube 42 and the cooling fin 44 are heated by the heater provided to the defrosting tube 46.

However, in the background art evaporator in a refrigerator, since the refrigerant tube 42, the cooling fin 44, and the defrosting tube 46 are connected as separate components, a cumbersome process for assembling them is required in fabrication of the evaporator, particularly, in the attachment of the cooling fins 44 to the refrigerant tube 42, the refrigerant tube 42 should be inserted into the cooling fins 44 arranged at fixed intervals and expanded for fixing the cooling fins 44 thereto. And, a contact resistance at welded parts of the refrigerant tube 42 and the cooling fin 44 drops a heat conductivity, with a consequential drop of a heat exchange efficiency. Moreover, in defrosting, minute gaps and contact resistances between the defrosting tube 46 and the cooling fins 44 causes a heat exchange poor, dropping a defrosting efficiency. That is, the background art evaporator has, not only a complicated fabricating process, but also poor heat exchange and defrosting efficiencies, thereby causing to have a low productivity and a low quality as a merchandise.

SUMMARY OF THE INVENTION

Accordingly, the present invention is directed to an evaporator in a refrigerator that substantially obviates one or more of the problems due to limitations and disadvantages of the related art.

An object of the present invention is to provide an evaporator in a refrigerator which has the refrigerant tube, cooling fins and the defrosting tube formed as one unit for simple structure and a better heat exchange efficiency, to improve a performance and a productivity of the refrigerator.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the refrigerator includes a case having a storage space divided into a freeze room and a cold room, and parts composing a refrigerating cycle such as a compressor, a condenser, an evaporator, and a capillary tube for cooling down temperatures in the freeze room and the cold room, wherein the evaporator includes one pair of refrigerant tubes for flow of refrigerant therethrough, a defrosting tube disposed between the two refrigerant tubes, and cooling fins formed as one unit with, and connecting the refrigerant tubes and the defrosting tube.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
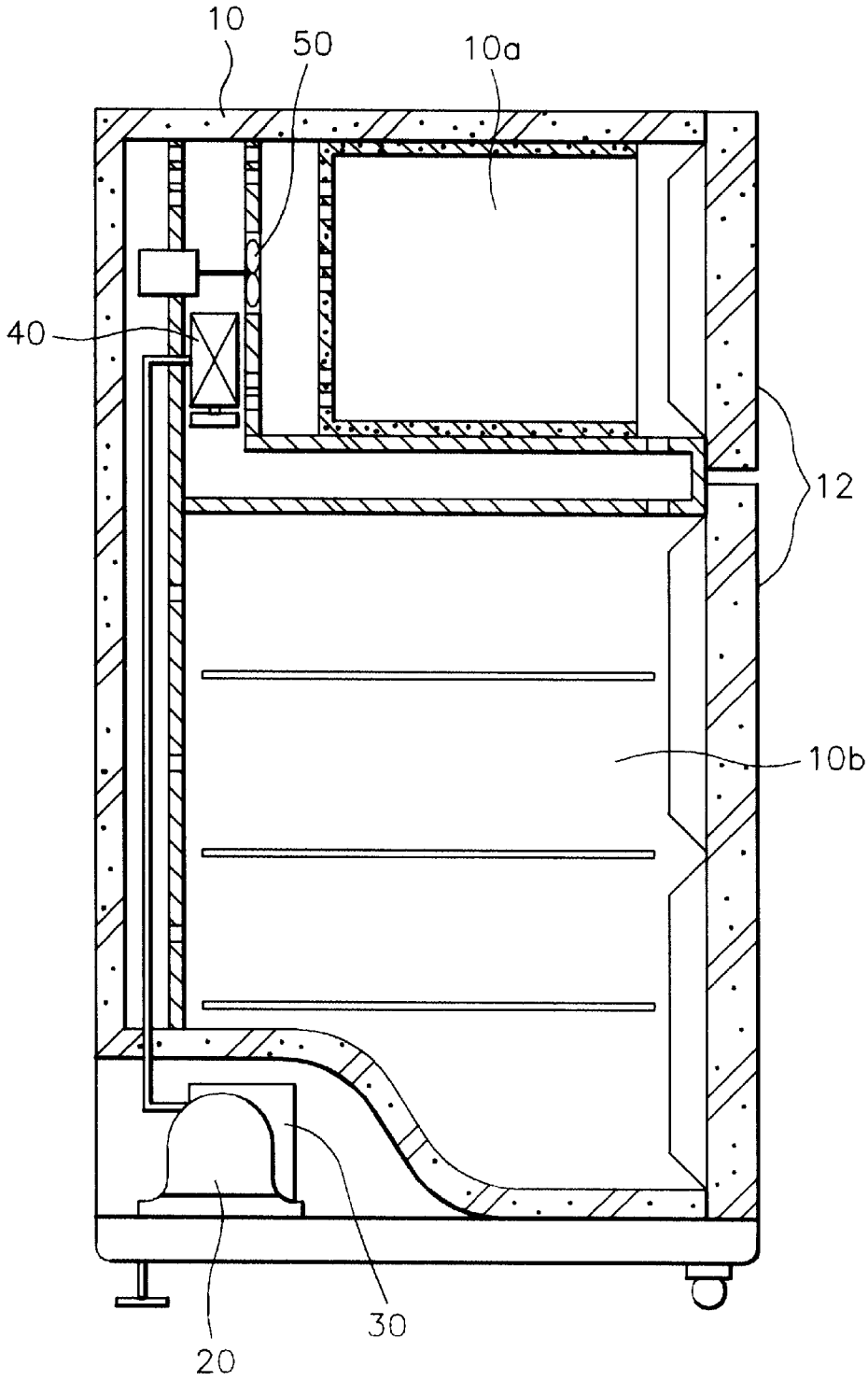
FIG. 1 prior art
FIG. 1 illustrates a section of a background art refrigerator.
Figure 2:
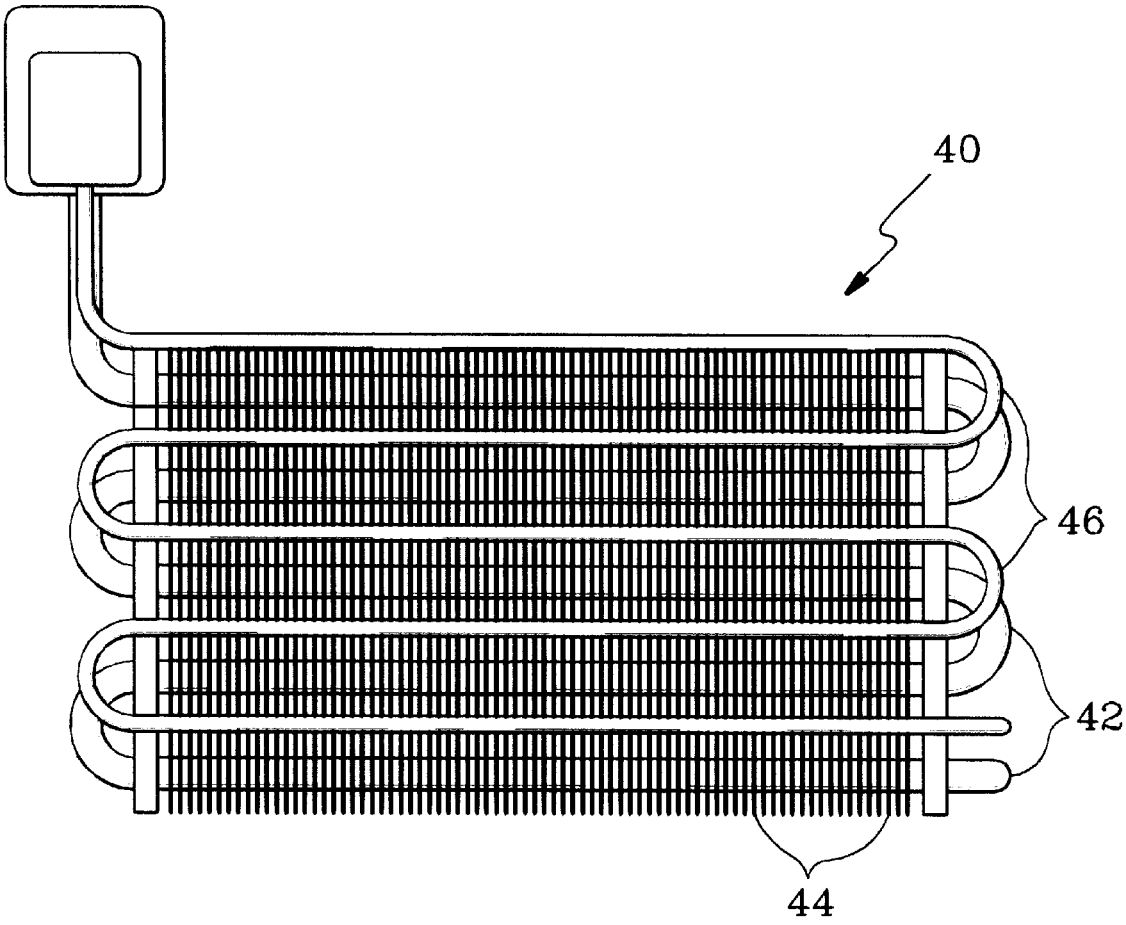
FIG.2 prior art
FIG. 2 illustrates a side view of a background art evaporator in a refrigerator.

Reference will now be made in detail to the preferred embodiments of the present invention, examples of which are illustrated in the accompanying drawings. Parts identical to the background art parts are given the same reference numerals and explanations of the parts will be omitted. Embodiments of the present invention will be explained with reference to FIGS. 3~9.

Figure 3:
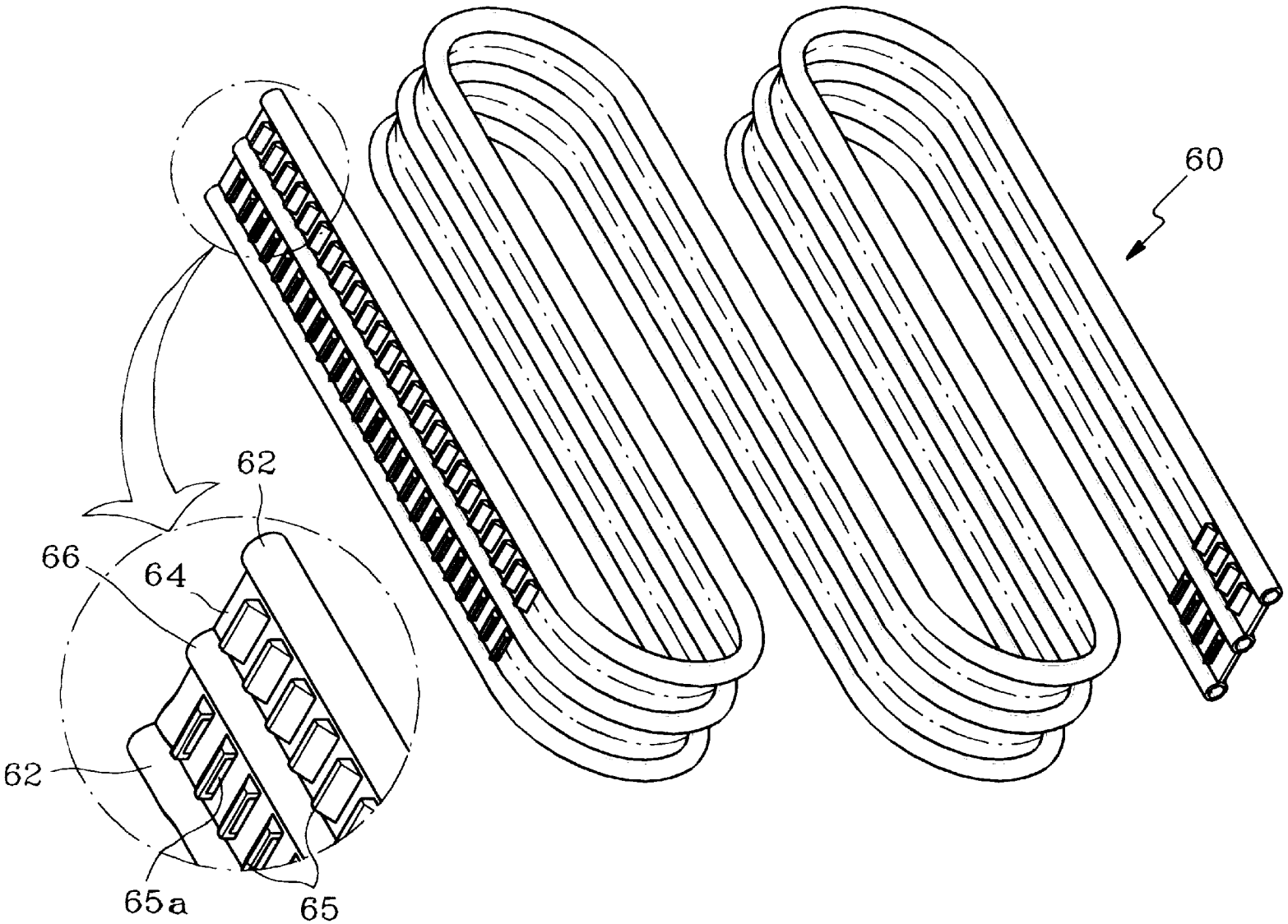
FIG. 3 illustrates a perspective view of an evaporator in a refrigerator in accordance with a preferred embodiment of the present invention and turbulence forming means applied thereto.

Referring to FIG. 3, the evaporator for a refrigerator in accordance with one preferred embodiment of the present invention includes one pair of refrigerant tubes 62, a defrosting tube 66 disposed between the two refrigerant tubes 62, and cooling fins 64 formed as a unit with, and connecting the refrigerant tubes 62 and the defrosting tube 66. The refrigerant tubes 62, the cooling fins 64, and the defrosting tube 66 are bent to form a continuous 'S' Thus, the evaporator 60 of the present invention having the refrigerant tubes 62, the cooling fins 64, and the defrosting tube 64 formed as one unit, has no contact resistances, thereby improving a heat exchange efficiency and a defrosting efficiency.

The evaporator 60 is provided with turbulence forming means for forming a turbulence in a process of air flow around the evaporator, that improves the heat exchange efficiency. As shown in FIG. 3, the turbulence forming means includes a plurality of air pass openings(not shown) formed in each of the cooling fins 64, and louvers 65 adapted to form openings 65*a* at a top and a bottom of each of the air pass openings in directions different from one another for changing directions of the air passing through the air pass openings. The openings 65*a* in the louvers 65 may be formed to face opposite directions with reference to the defrosting tube 66, for forming a greater turbulence. Thus, the variety of flow directions of the air passing through the air pass openings in passing through the evaporator 60 in the aforementioned turbulence forming means of the present invention allows to form a greater turbulence.

Figure 4A:
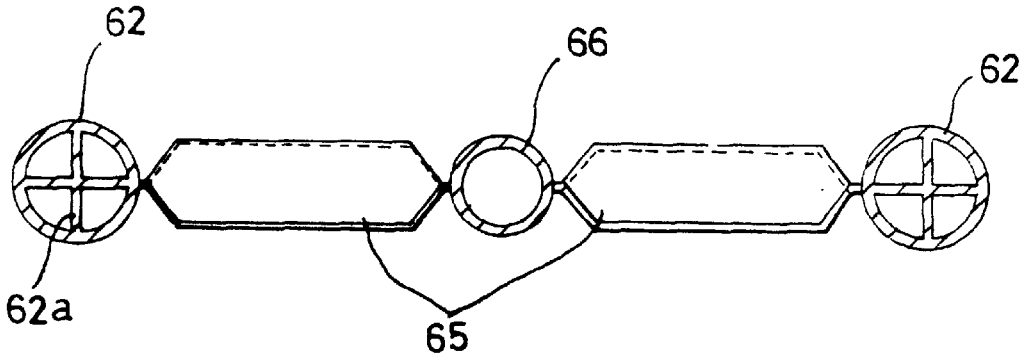
FIGS. 4*a* and 4*b* illustrate sections of in terminal heat conduction area enlarging means applied to a refrigerant tube in an evaporator of a refrigerator in accordance with embodiments of the present invention.
Figure 4B:
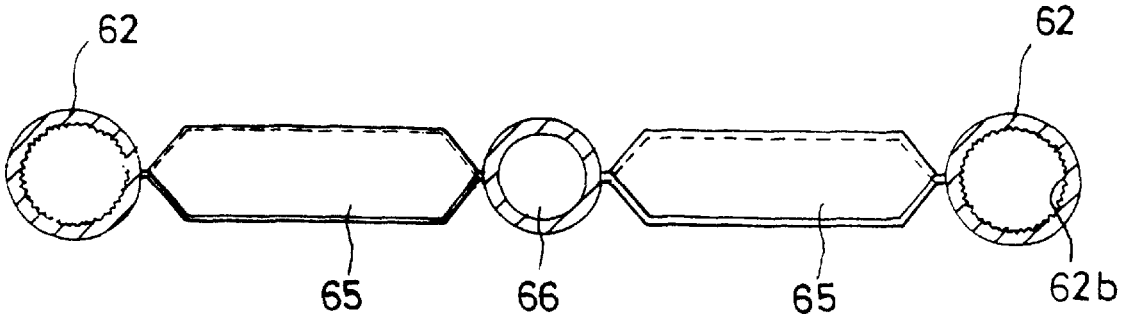

And, the evaporator 60 of the present invention may include internal heat conduction area enlarging means which enlarges an internal area of the refrigerant tubes 62 for improving a heat exchange efficiency. As one embodiment of the present invention, as shown in FIG. 4*a*, the internal heat conduction area enlarging means may be a heat exchange enhancing member 62*a* having a '+' formed section disposed in the refrigerant tube 62 with four ends thereof in contact with internal surfaces of the refrigerant tube 62. As another embodiment of the present invention, as shown in FIG. 4*b*, the internal heat conduction area enlarging means may be fins 62*b* formed on an internal circumference of the refrigerant tube 62. Thus, the aforementioned internal heat conduction area enlarging means enlarges a contact area between the refrigerant tube 62 and the refrigerant, lowering a temperature of the refrigerant tube 62 further which improves the heat exchange efficiency, again.

Figure 5A:
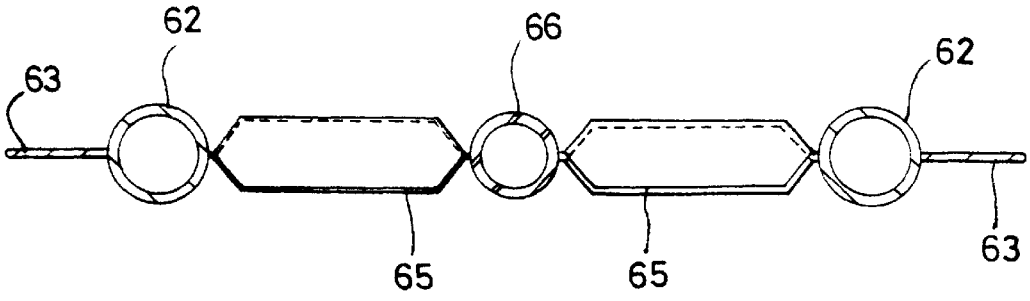
FIGS. 5*a* and 5*b* illustrate sections of external heat conduction area enlarging means applied to a refrigerant tube in an evaporator of a refrigerator in accordance with embodiments of the present invention.
Figure 5B:
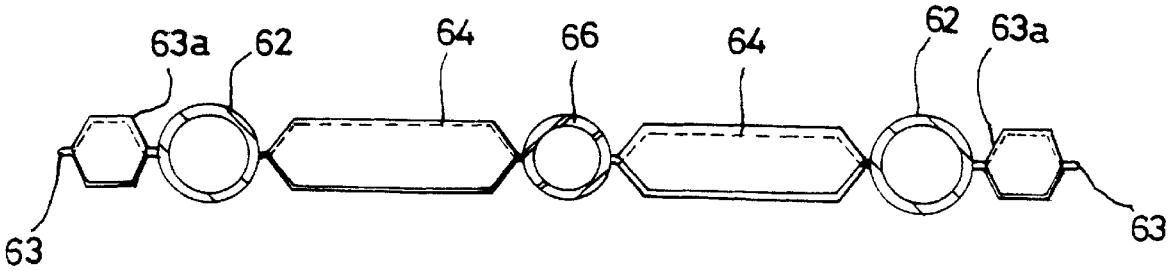

And, the evaporator 60 of the present invention may further include external heat conduction area enlarging means which enlarges an external area of the refrigerant tubes 62 for improving a heat exchange efficiency. As shown in FIG. 5*a*, as one embodiment of the present invention, the external heat conduction area enlarging means may be supplementary cooling fins 63 provided on an external surface of the refrigerant tube 62. And, as shown in FIG. 5*b*, the supplementary cooling fins 63 may be provided with supplementary louvers 63*a* having a plurality of air pass openings(not shown) and openings at top and bottom of the air pass openings in directions different from one another for changing directions of the air passing through the air pass openings. Thus, the aforementioned external heat conduction area enlarging means, i.e., the supplementary cooling fins 63, not only enlarges a contact area of the air to the refrigerant tubes 62, but also forms a greater turbulence of the air, thereby improving the heat exchange efficiency.

Figure 6:
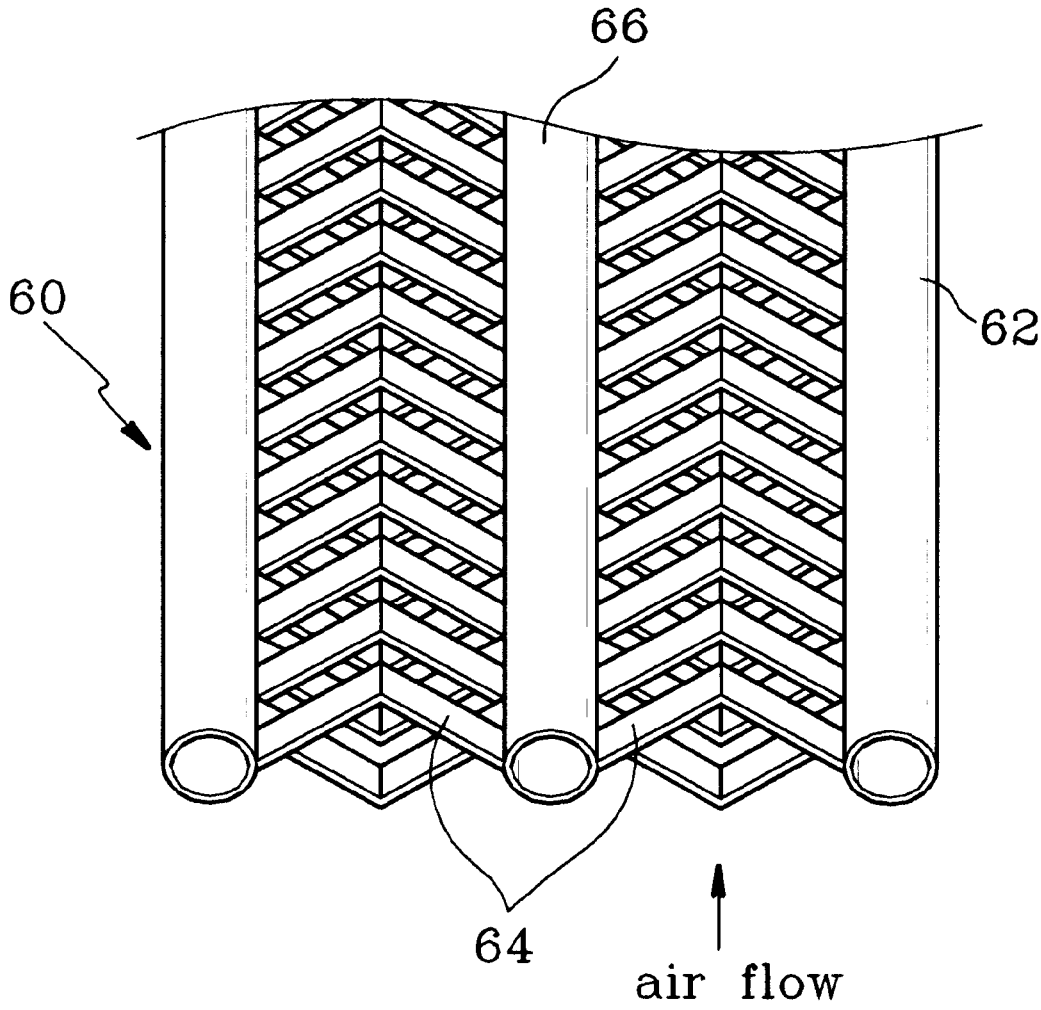
FIG. 6 illustrates a perspective view showing a structural change of cooling fins in an evaporator of a refrigerator in accordance with one embodiment of the present invention.

And, referring to FIG. 6, the cooling fins 64 in accordance with one embodiment of the present invention applied to the evaporator 60 have a plurality of divisions in a length and a vertical directions of the refrigerant tubes 62 each with a bend at a middle. Each of the divided cooling fins 64 are bent in an opposite direction to each other to cross one another. Thus, the air forms a turbulence as the air scattered by the cooling fins 64 in a process passing through the evaporator 60. And, as the evaporator 60 has an enlarged contact area to the air due to the cooling fins 64 of which heat conduction area is increased in comparison to the plate form of cooling fins, at the end, the evaporator 60 of the present invention has an improved heat exchange efficiency.

Figure 7A:
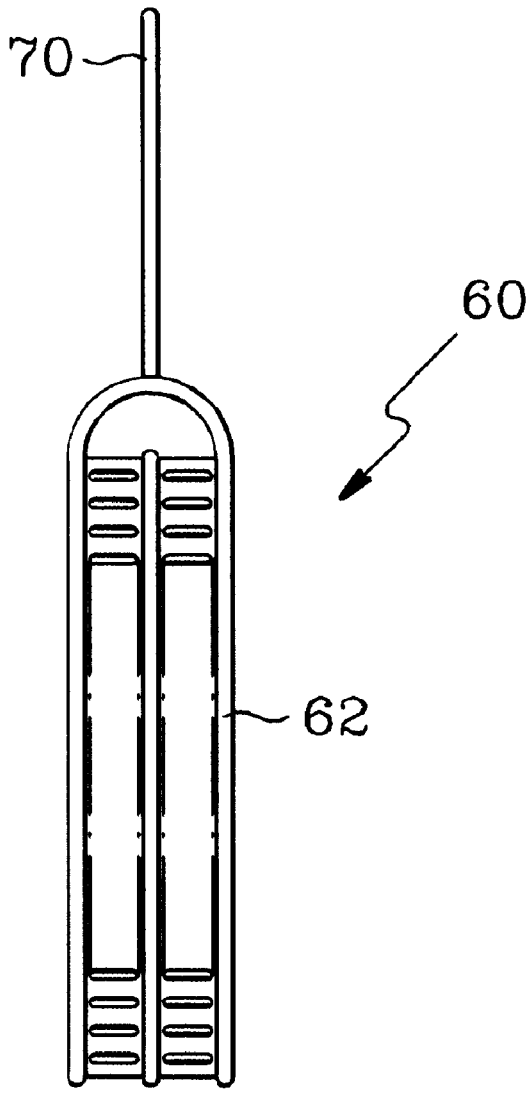
FIGS. 7*a* and 7*b* illustrate side views each showing a structural change of cooling fins in an evaporator of a refrigerator in accordance with one embodiment of the present invention.
Figure 7B:
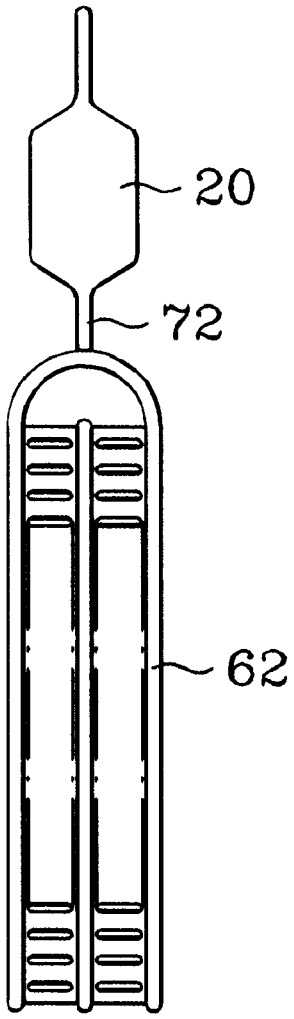

And, the evaporator 60 includes a single refrigerant inlet tube 70 at one side thereof for inlet of the refrigerant, one pair of the refrigerant tubes 62 for equal division of the refrigerant flows in through the refrigerant inlet tube 70 as shown in FIG. 7*a*, and a single refrigerant outlet tube 72 for discharge of the refrigerant passed through the refrigerant tubes 62 as shown in FIG. 7*b*. That is, though the evaporator 60 has a length the same with the background art evaporator, since an inlet and an outlet of the refrigerant are positioned at opposite sides to flow the refrigerant in one direction, and the refrigerant flows through, not a single refrigerant tube, but two refrigerant tubes 62 in one direction on the same time, with a less pressure loss, the heat exchange performance is improved.

Figure 8:
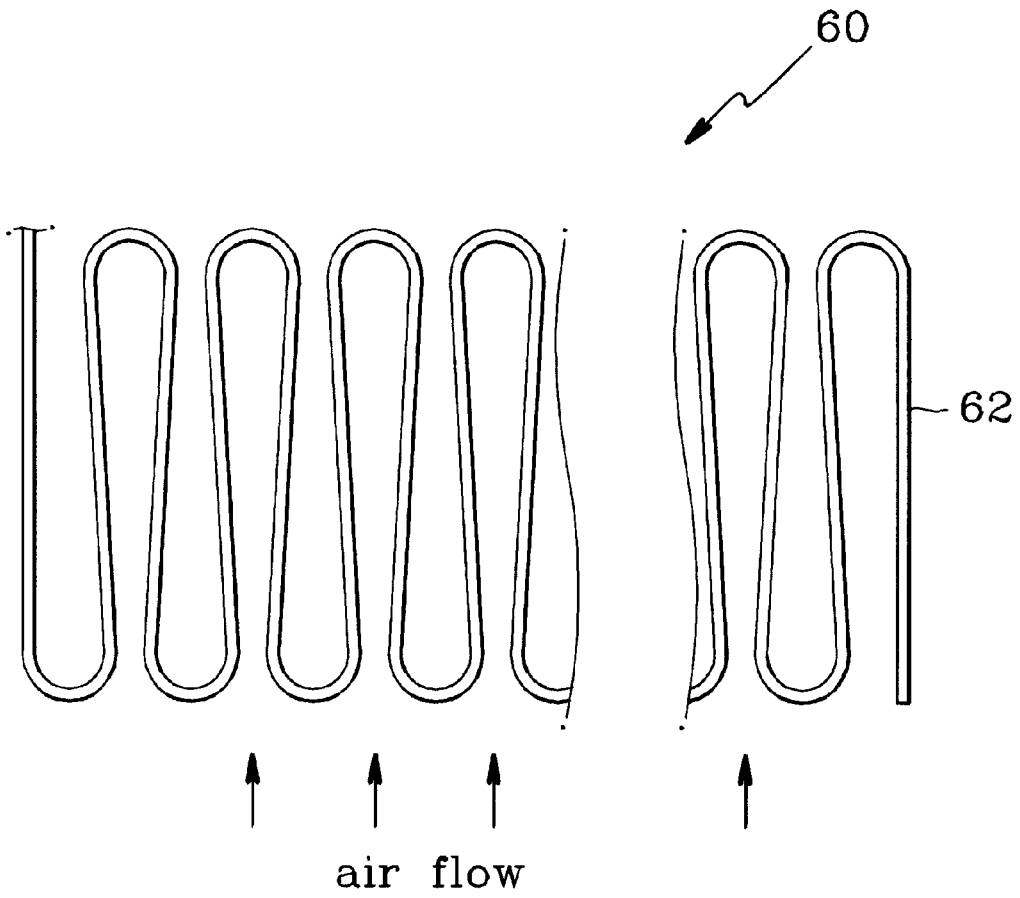
FIG. 8 illustrates a plane view of bent refrigerant tube in an evaporator for a refrigerator in accordance with one embodiment of the present invention; and, FIG. 9 illustrates a front view showing a change of mounting angle of an evaporator for a refrigerator in accordance with one embodiment of the present invention.
Figure 9:
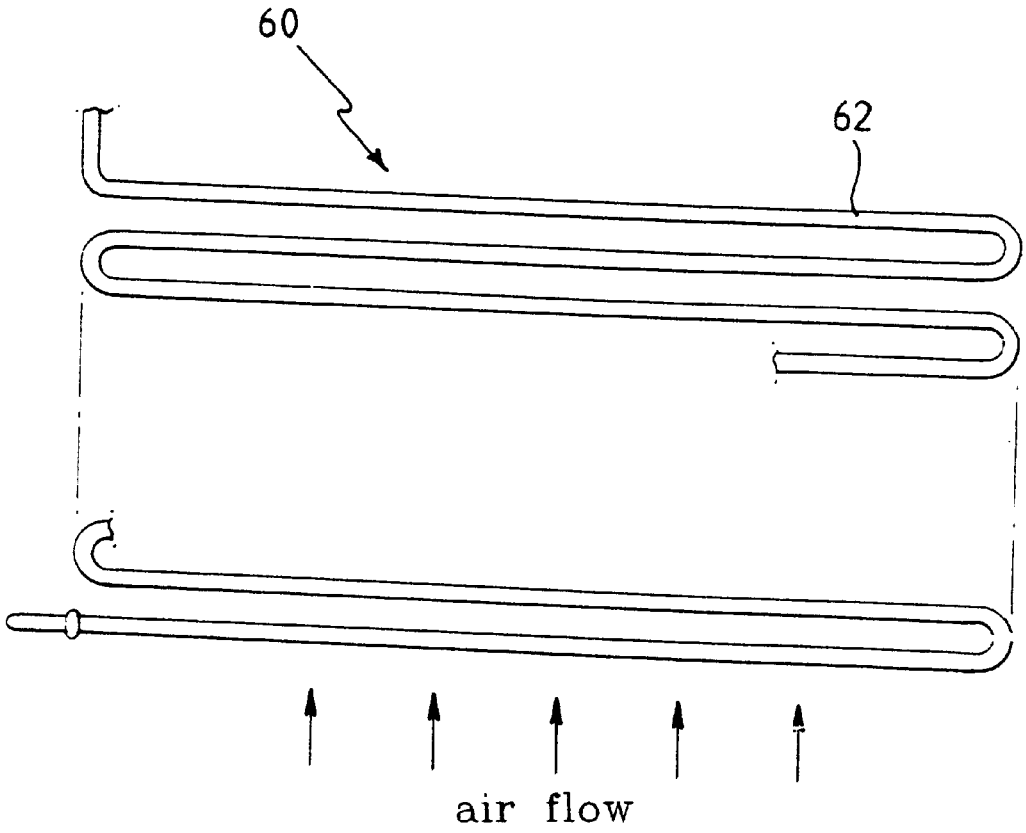

In addition to this, the evaporator 60 is bent such that openings for flow of the air are formed narrow, to reduce an area of the air pass and to induce the air to scatter to other parts as shown in FIG. 8. Accordingly, as the air is caused to make a uniform contact with an entire parts of the evaporator 60 in a process passing through the evaporator 60, the heat exchange efficiency is improved. Opposite to this, bending of the refrigerant tubes 62 may not be adjusted, but an angle of mounting of the evaporator 60 itself may be changed as shown in FIG. 9, to make the direction of flow of the refrigerant and the direction of flow of the air perpendicular for increasing a contact area of the refrigerant tubes 62 with the air. As an area of the refrigerant tube 62 within a path of the air is increased, with an increased formation of the turbulence, the heat exchange efficiency is improved.

The evaporator in a refrigerator of the present invention as has been explained has the following advantages.

The refrigerant tube 62, the cooling fins 64, and the defrosting tube 66 formed as one unit allows a simple fabrication process and elimination of contact resistances. And, as an area in contact with the air is increased and formation of turbulence of air becomes active, the heat exchange efficiency is improved. Thus, in conclusion, a productivity and performance of the overall refrigerator can be improved.

It will be apparent to those skilled in the art that various modifications and variations can be made in the evaporator in a refrigerator of the present invention without departing from the spirit or scope of the invention. Thus, it is intended that the present invention cover the modifications and variations of this invention provided they come within the scope of the appended claims and their equivalents.

What is claimed is:

1. A refrigerator including a case having a storage space divided into a freeze room and a cold room, and parts composing a refrigerating cycle such as a compressor, a condenser, an evaporator, and a capillary tube for cooling down temperatures in the freeze room and the cold room, the evaporator comprising:

one pair of refrigerant tubes for flow of refrigerant therethrough;

a defrosting tube disposed between the two refrigerant tubes;

cooling fins formed as one unit with, and connecting the refrigerant tubes and the defrosting tube;

internal heat conduction enlarging means located within said pair of refrigerant tubes; and turbulence forming means adapted to form a turbulence in air flowing around the evaporator for improving a heat exchange efficiency, wherein the turbulence forming means includes;

a plurality of air pass openings formed in the cooling fins, and a plurality of louvers, wherein each of said louvers is formed around a respective air pass opening and on one side of the cooling fins to cover the respective air pass opening and form a louver opening, wherein a first set of said louvers is disposed between a first of said refrigerant tube and said defrosting tube, a second set of said louvers is disposed between a second of said refrigerant tube and said defrosting tube, and a direction of air passing through the louver openings of the first set of said louvers is opposite to a direction of air passing through the louver openings of the second set of said louvers, wherein the louver opening of each of said louvers defines a plane that is transverse to a plane of the respective air pass opening.

2. A refrigerator as claimed in claim 1, wherein said internal head conduction area enlarging means adapted to enlarge an internal area of the refrigerant tubes for improving a heat exchange efficiency has a cruciform cross section.

3. A refrigerator as claimed in claim 1, wherein the internal heat conduction area enlarging means comprises fins formed on an internal circumference of the refrigerant tubes.

4. A refrigerator as claimed in claim 1, wherein the evaporator further includes external heat conduction area enlarging means adapted to enlarge an external area of the refrigerant tubes for improving a heat exchange efficiency.

5. A refrigerator as claimed in claim 4, wherein the external heat conduction area enlarging means includes supplementary cooling fins at external surfaces of the refrigerant tubes.

6. A refrigerator as claimed in claim 5, wherein the supplementary cooling fins include;

a plurality of air pass holes, and, louvers each covering the air pass hole and forming an opening at one side thereof for diverting a direction of air flow passing through the air pass holes.

7. A refrigerator as claimed in claim 1, wherein the evaporator includes;

a single refrigerant inlet tube at one side thereof for inlet of the refrigerant, one pair of the refrigerant tubes for equal division of the refrigerant flowing in through the refrigerant inlet tube, and a single refrigerant outlet tube for discharge of the refrigerant passed through the refrigerant tubes.

8. A refrigerator as claimed in claim 1, wherein the refrigerant tubes, the defrosting tube, and cooling fins are bent in 'S' form such that openings for flow of the air are formed narrow, to reduce an area of the air pass and to induce the air to scatter to other parts.

9. A refrigerator as claimed in claim 1, wherein the refrigerant tubes are bent such that a flow direction of the refrigerant and a flow direction of the air passing through the evaporator are perpendicular to each other.

* * * * *